US005456966A

United States Patent [19]

Austin

[11] Patent Number: 5,456,966

[45] Date of Patent: Oct. 10, 1995

[54] ANTISKID FLOOR MAT

[76] Inventor: John R. Austin, 899 El Centro, South Pasadena, Calif. 91030

[21] Appl. No.: 289,236

[22] Filed: Aug. 11, 1994

[51] Int. Cl.[6] ..... E01C 5/18; B32B 3/24

[52] U.S. Cl. ..... 428/120; 428/179; 428/180; 52/177; 404/35

[58] Field of Search ..... 428/120, 178, 428/179, 180; 52/177; 404/35

[56] References Cited

U.S. PATENT DOCUMENTS

| | | | |
|---|---|---|---|
| D. 238,538 | 1/1976 | Smith | D6/226 |
| 348,782 | 9/1886 | Sawyer | 428/120 |
| 3,251,076 | 5/1966 | Burke | 5/351 |
| 3,699,926 | 10/1972 | Stockl | 119/28 |
| 3,922,409 | 11/1975 | Stark | 428/44 |
| 4,133,481 | 1/1979 | Bennett | 238/14 |
| 4,287,693 | 9/1981 | Collette | 52/177 |
| 4,478,901 | 10/1984 | Dickens | 428/120 |
| 4,807,412 | 2/1989 | Frederiksen | 52/177 |
| 4,973,505 | 11/1990 | Bielous | 428/44 |

*Primary Examiner*—Alexander S. Thomas
*Attorney, Agent, or Firm*—John F. Sicotte

[57] ABSTRACT

A floor mat is provided with a generally flat upper wall with a multitude of y-shaped ribs extending vertically downward from the upper wall to a floor surface, supporting the mat. Each of the y-shaped ribs has a solid central core with three legs which extend horizontally radially outward from the core. The distal end of each of the legs is bulbously enlarged. The ribs are spaced apart in a symmetrical pattern so that two sides of three adjacent ribs cooperatively define a generally cylindrical pocket. The pocket, while forming an enclosure, nevertheless had lateral openings at three equally spaced locations formed by the ends of each of two adjacent ribs being spaced slightly apart allowing for ingress and egress of air from the pocket. Located above the center of each pocket is a hollow dome formed in the upper wall.

3 Claims, 4 Drawing Sheets

ANTISKID FLOOR MAT

BACKGROUND OF THE INVENTION

The present invention relates to antiskid floor or anticreep mats and particularly to floor mats which are used to relieve the fatigue of a person who works in a single location.

DESCRIPTION OF THE RELATED ART

Prior to this invention, slippage or creeping of floor mats has always been a problem in wet or dry applications. In order to save material and to make lighter floor mats, manufacturers have made mats designed with knobs, feet or cells under the mat. The purpose of this design was to raise the mat above the surface of the floor in order to keep the mat dry. These knobs or feet would also provide a resilient base for the user. This design, however, was problematic in that the mats tended to skid or creep out of position due to the resilient supports being deformed under pressure and returning to different position on the floor, resulting in the mat eventually moving out of place. This is particularly annoying to a worker who must repeatedly reposition a mat throughout the day. Furthermore the movement of a mat can become hazardous in that it may slip or become furled on one edge, causing a worker to trip or fall.

One solution to the problem was suggested by Dickens, U.S. Pat. No. 4,478,901 whose primary objective was to provide a durable nonskid floormat. The mat was designed with dumbbell shaped, three of which surrounded an opening in the mat surface to allow for drainage. The feet are positioned 120 degrees from each other with their sides facing the opening. While the Dickens' mat is somewhat resistant to skidding or creeping, it does not entirely solve the problem. Due to the dumbbell design of the supports the top of the feet can be moved out of alignment with the bottom of the feet by horizontal forces being applied to the surface of the floor mat. This is because the feet have a vertical face largely unreinforced against lateral forces. The present invention overcomes the problems associated with floor mats that skid or creep by providing a mat support in the form of the y-shaped structure that better resists deformation of the supports. Additionally, the present invention provides a means to keep the underside of a mat dry by the promotion of air circulation.

SUMMARY OF THE PRESENT INVENTION

The system of the present invention provides a mat for dry areas which is relatively uncomplicated in construction and yet provides a consistently comfortable mat which does not slip or creep at a relatively low cost. The mat is particularly suited for use in areas where there is prolonged standings. It also can be in areas where persons are walking across the mat causing the mat to creep or walk. The desirable qualities of a mat are achieved in the preferred embodiment of the invention of employing hollow dome like projections of the upper surface of a rubber membrane which is supported by a ring of three tri-legged support members surrounding equally spaced around the underside of each dome.

Such construction allowing the incorporation of a relatively inexpensive means of resiliently supporting the weight of a person and yet provides a means to retain the position of the mat on the floor, as well as keeping the underside of the mat dry, protecting the underlying flooring. These and other features, objects and advantages of the present invention can be best understood by reference to the accompanying drawings.

DETAILED DESCRIPTION OF THE PREFERRED EMBODIMENT

Figure 1:
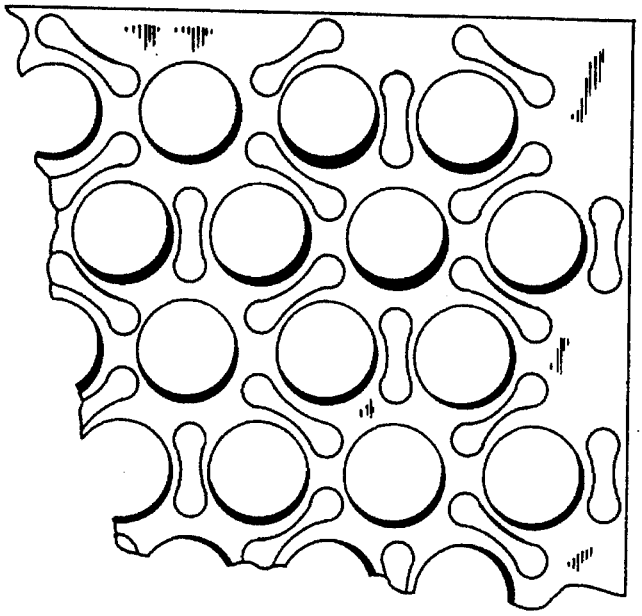
Prior Art FIG. 1
FIG. 1 is a bottom fragmentary view of a prior art floor mat.
Figure 3A:
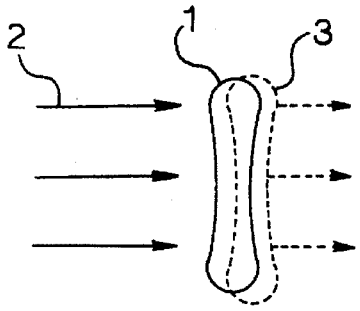
FIG. 3*a* is a bottom view of a single support of a prior art mat shown in FIG. 1.

Referring initially to FIG. 1 there is shown a prior art floor mat illustrating a portion of a bottom of a mat constructed in accord with the teachings of the Dickens patent. It is constructed with support members that are particularly designed to prevent slippage and to maintain a reduced weight per mat area. In FIG. 1 it can be seen that each support member has an elongated barbell-like footprint. Each member extends from the underside of the mat and has substantially vertical side surfaces. The problem with this type of construction is that when the user walks or steps in a horizontal direction across the surface of the mat the support members tend to deform. The movement of the user introduces a lateral force at the top of the member while the bottom of the member remains anchored to the floor. When this force is released the support member will resume its original form, causing the bottom surface of the member to move slightly in the direction of the horizontal force. After numerous introduction of such forces the mat tends to move out of position, resulting in "creeping" or "walking" of the mat after a period of time. FIG. 3*a* illustrates the bottom surface of a single support member 1 which has been constructed in accordance with the prior art. Support member 1 is shown as being in its normal state, prior to the introduction of any lateral forces to the top surface of the mat. A lateral of force is indicated being applied at 2. As a result of the application of lateral force 2, support 1 is deformed in the direction of force 2. When lateral force 2 is released, support member 1 recovers its shape and relocates itself to a new position in the direction of lateral force 2. This is illustrated in phantom as support member 3.

Figure 2:
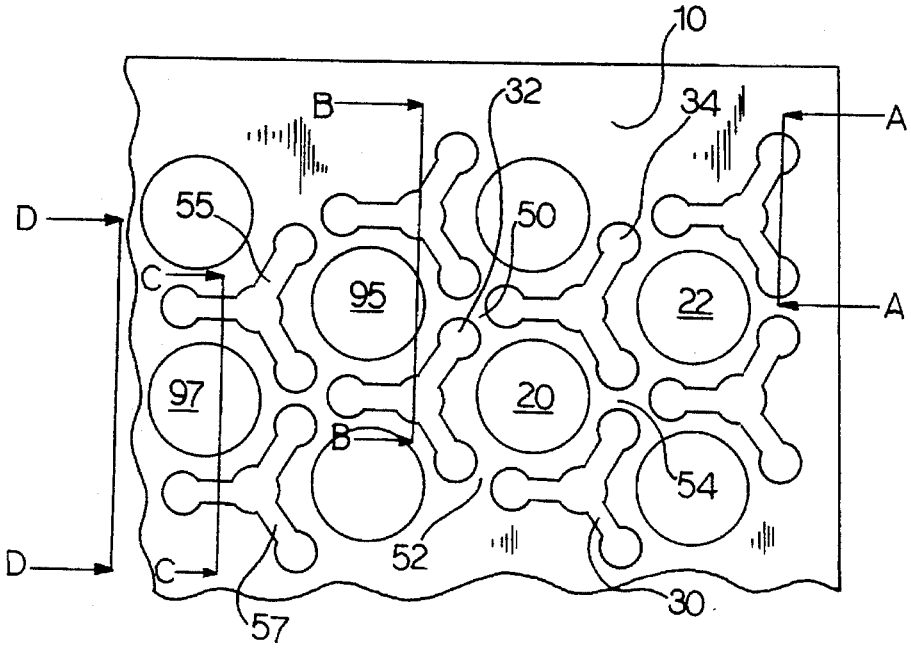
FIG. 2 is a bottom fragmentary view of the preferred embodiment of the invention.
Figure 3B:
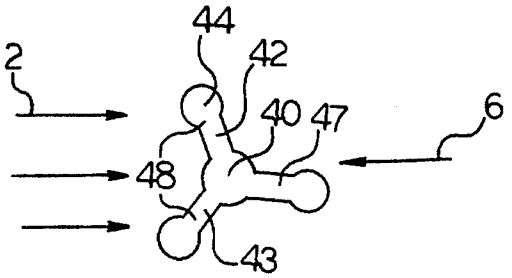
FIG. 3*b* is a bottom view of a single support of the preferred embodiment.

Referring now to FIGS. 2 and 3*b* there is illustrated a portion of the bottom of a floor mat 10 constructed accord with the present invention. A dome 20 is shown being substantially surrounded by three y-shaped supports 30, 32 and 34. In the embodiment shown, dome 20 is formed in mat 10 so as to have a raised top surface 22 (shown in FIG. 4) and a concave inner surface 24 (shown in FIG. 5). It is to understood that dome 20 and associated y-shaped supports 30, 32 and 34 are formed in a mold simultaneously along with mat 10.

FIG. 3*b* illustrates a single y-shaped support to show its reaction to an impinging lateral force. The y-shaped support is composed of a solid central core 40 which has three legs 42, 43 and 47 which extend radially outward from central core 40. Leg 42,43 and 47 are comprised of walls 62,63 and 67, respectfully. Each of the walls 62,63 and 67 has a bulbously enlarged distal end 72, 73 and 77, respectfully. For comparison purposes a lateral force 2 is the same force as previously discussed in FIG. 3*a*. It can be seen in FIG. 3*b* when the same force is laterally applied to the y-shaped support it is opposed by the combination of two legs, 42 and 43. Legs 42 and 43 form a combined wall 48 which will initially resist force 2. Combined wall 48 is reinforced by leg 47 which is positioned 120 degrees from either of leg 42 and 43. The function of leg 47 is to provide a structure that generates a counter force 6. When force 2 impinges on combined wall 48 formed by legs 42 and 43 it will tend to cause the combined wall 48 to deform in the direction of the force. This, however, cannot occur due to the counterforce 6. Combined wall 48 will remain substantially vertical and avoiding the repositioning of the support when the support reverts to its normal shape.

Figure 3C:
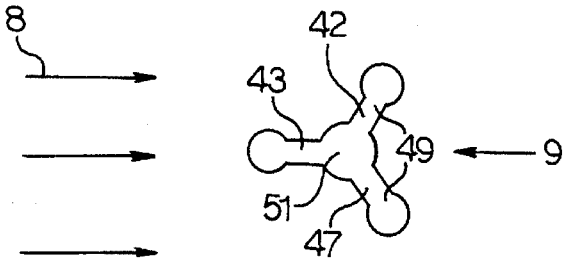
FIG. 3*c* is a bottom view of the single support shown in FIG. 3*b* turned 180 degrees.

The present invention will resist deformation of the y-shaped regardless of the direction of the lateral force 2. FIG. 3*c* shows the same y-shaped support illustrated in FIG. 3*b* but it is now being effected by a new lateral force 8. Force 8 is directed in line with leg 43 and the junction of legs 42 and 47. It can be clearly seen that force 8 will tend to deform leg 43 by pushing it toward the central core 51 and junction of legs 42 and 47. Force 8, however, will be opposed by counterforce 9 which is generated by the opposition presented by legs 42 and 47. Legs 42 and 47 are positioned 120 degrees apart from each other and cooperatively form a combined wall 49 that supports central core 51 which in turn opposes any movement by leg 43. In this example wall 49 is providing the opposite function to wall 48. In that situation combined wall 48 received the initial impact of the lateral force and in this case wall 49 supports leg 43 which receives the initial impact of the lateral force.

It needs to be understood that if a lateral force impinges upon a y-shaped from any direction, then a y-shaped support will resist such force using a combination composed of force 8 and force 9 type counterforces depending upon the direction of the lateral force. A lateral force will always be opposed by a counterforce composed of two forces. One counterforce is generated by the opposing effect of wall in the y-shaped support and the other counterforce is generated by the opposing effect of the remaining leg.

In FIG. 2 it can be seen that the y-shaped ribs are spaced apart in a symmetrical pattern so that two legs of three adjacent rigs form a generally cylindrical enclosure. This arrangement is clearly illustrated in FIG. 2. Supports 30, 32 and 34 surround dome 20. The enclosure, while forming a pocket, nevertheless has lateral openings at three equally spaced locations formed by the ends of two adjacent ribs being spaced slightly apart. The openings are indicated by reference numerals 50, 52 and 54 in FIG. 2. The openings allow for the ingress and the egress of air so that there can be a current of air flow under the mat to evaporate moisture or humid air that may collect under the mat. It should be noted in FIG. 2 that a hollow dome is centrally located above each cylindrical pocket. When a user compresses this dome by walking or stepping upon the mat, a small amount of air is forced downward into the cylindrical pocket and through its associated lateral openings. The user of a mat has a tendency to constantly shifting their weight and compressing different domes at random locations on the mat. This causes a constant flow of air throughout the underside of the mat thereby tending to keep the y-shaped supports dry. This is important because moisture will deteriorate a mat and discolor the underlying surface.

Figure 4:
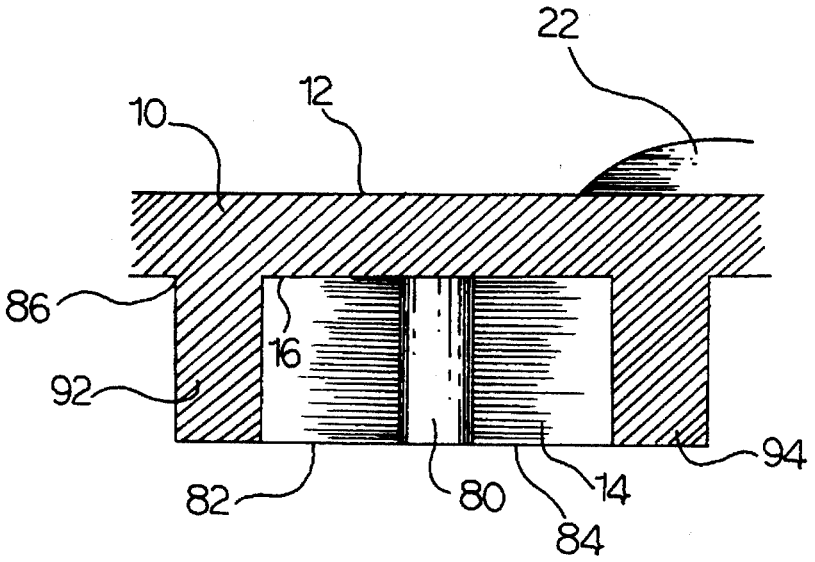
FIG. 4 preferred embodiment taken along line A—A in FIG. 2.

Referring now to FIG. 4 there is shown a cross-sectional view of the invention with an integrally formed mat structure 10 composed of a resilient material. Member 10 has a substantially flat upper wall 12 and an integrally formed Y-shaped rib structure 14 which extends downward from the underside 16 of upper wall 12. Rib structure 14 includes a central core 80 and three separate legs which extend radially outward from central core. In FIG. 4 it can be seen that legs 82 and 84 are integrally formed with upper wall 12 and have bulbous ends 92 and 94, respectfully. If a laterally force is applied to upper wall 12, then such force will be in turn applied to the top of legs 82 and 84 in the region indicated at 86. Such force will tend to deform the top of legs 82 and 84 in the direction of the force. In the prior art floor mat legs or supports would actually deform or bend and then recover their shape due to their being constructed of resilient material. Upon recovery the prior art supports would reposition themselves in the direction of the lateral force. This repositioning of prior art supports is illustrated in FIG. 3*a*. In the present invention, however, deformation and repositioning has been minimized. Legs 82 and 84 will resist deformation in region 86 due to the unique design of the supports, as discussed above. FIG. 4 also shows a partial view of dome 22 rising above upper wall 12.

Figure 5:
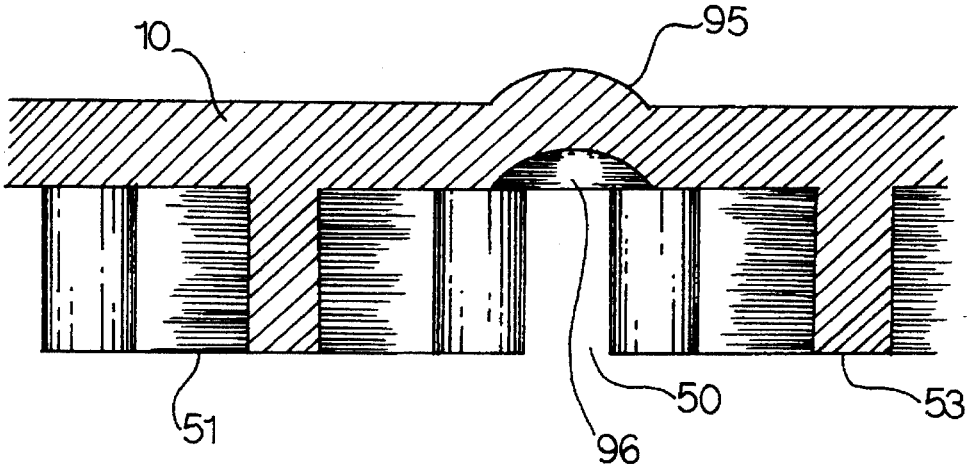
FIG. 5 is a fragmentary elevational view of the preferred embodiment taken along line B—B in FIG. 2.
Figure 6:
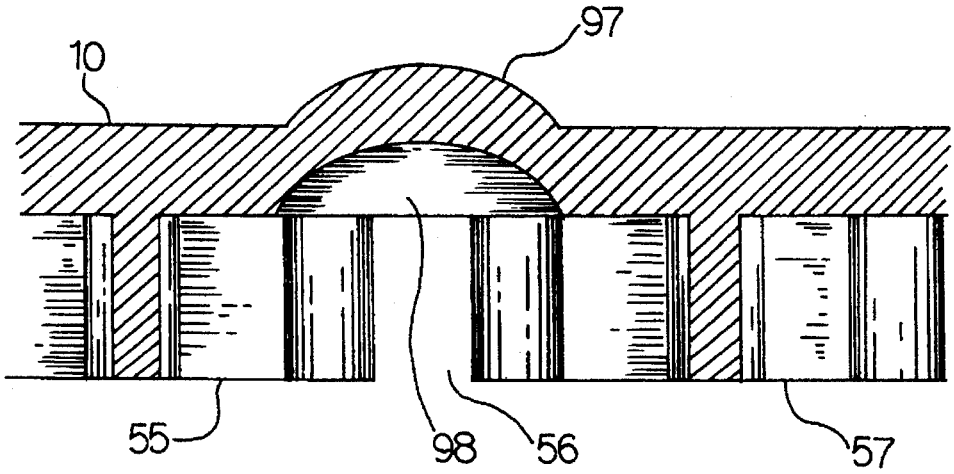
FIG. 6 is a fragmentary elevational view of the preferred embodiment taken along line C—C.
Figure 7:
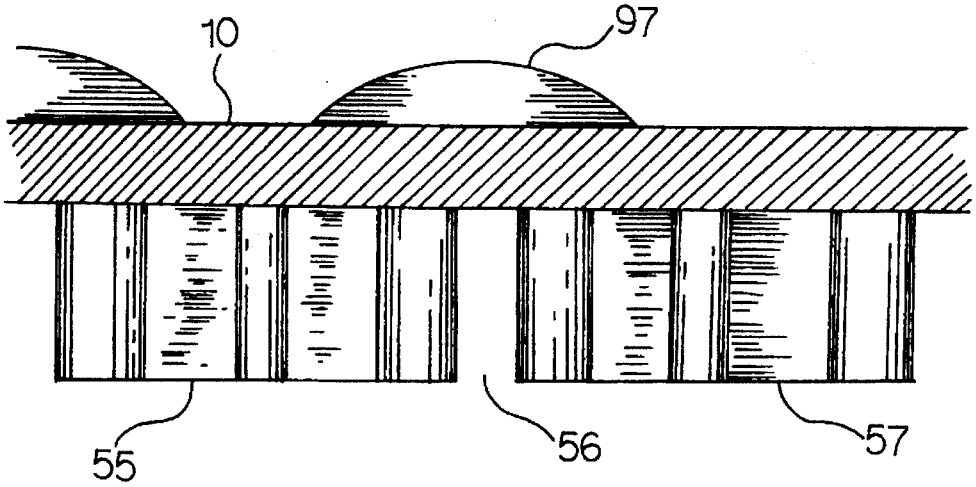
FIG. 7 is a fragmentary elevational view of the preferred embodiment taken along line D—D.

In FIGS. 5, 6 and 7 there are illustrated various cross-sectional views of the of mat structure 10 showing the domes in relationship to the y-shaped supports and the openings between the supports. In FIG. 5 the opening between two y-shaped support members, 51 and 53, is indicated at 50. In this particular cross-sectional view, a dome 95 is shown beginning to rise above mat 10 and is partially visible. Dome 95 has a concave underside 96 which is near opening 50. FIG. 6 is a cross-sectional view of a dome 97 taken nearly through the center of the dome, which is shown integrally formed with mat 10. On either side of dome 97 are y-shaped supports 55 and 57. In FIG. 6 it can be seen that the concave underside 98 of dome 97 contains a volume of air. In use dome 97 will occasionally be compressed by the user and the volume of air under the dome will be forced through opening 56. It should be noted that the compression of dome 97 will impart few lateral forces into mat 10. The vertical forces applied by the user will be largely absorbed by the collapse of the dome. Whatever lateral forces imparted into mat 10 will have little effect on the supports due to their design. This can be seen in FIGS. 2 and 7 where dome 97 is shown located between y-shaped supports 55 and 57. When dome 97 is flattened out its material will move into concave underside 98 (in FIG. 6) thus absorbing nearly all of the force. Any remaining forces which radiate outward from dome 97 will be absorbed by the surrounding y-shaped supports, including supports 55 and 57.

I claim:

1. A mat for providing resilient, non-skid support upon a flat surface, comprising:

an integrally formed elastomeric member having a generally flat upper wall, a plurality of generally y-shaped ribs extending vertically downward from said wall, the three ends of each of said ribs having a bulbous enlargement, said ribs being spaced apart in a symmetrical pattern such that two sides of three adjacent ribs cooperatively define a generally cylindrical pocket, said pocket providing an enclosure which nevertheless has lateral openings at three equally spaced locations, the ends of each two adjacent ribs being spaced slightly apart to provide said openings, thus allowing ingress and egress of air from said pocket in response to vertical pressure on said wall, and said wall having a hollow dome portion above each of said pockets.

2. A mat for providing resilient, non-skid support upon a flat surface, comprising an integrally formed elastomeric member having:

a generally flat upper wall, a multitude of ribs extending vertically downward from said wall to engage the flat surface and support the mat thereon, each of said ribs having a central core and three separate legs which extend horizontally radially outward from said core, the ends of said ribs being bulbously enlarged, and said core, said legs, and said bulbous enlargements all being of equal vertical height so that all of them engage the flat surface concurrently.

3. A mat as in claim 2 wherein said legs are equally spaced at circumferential angles of 120 degrees, thereby frictionally supporting the mat against horizontal forces in any direction.

* * * * *